US005952147A

United States Patent [19]

Dickerson et al.

[11] Patent Number: 5,952,147

[45] Date of Patent: Sep. 14, 1999

[54] PORTAL VERIFICATION RADIOGRAPHIC ELEMENT AND METHOD OF IMAGING

[75] Inventors: Robert E. Dickerson, Hamlin; Stephen A. Hershey, Fairport; James C. Bolthouse, Spencerport, all of N.Y.

[73] Assignee: Eastman Kodak Company, Rochester, N.Y.

[21] Appl. No.: 09/069,528

[22] Filed: Apr. 29, 1998

[51] Int. Cl.[6] ..... G03C 5/16

[52] U.S. Cl. ..... 430/139; 430/502; 430/571; 430/966

[58] Field of Search ..... 430/571, 966, 430/502, 139

[56] References Cited

U.S. PATENT DOCUMENTS

| | | | |
|---|---|---|---|
| 4,414,304 | 11/1983 | Dickerson . | |
| 4,425,425 | 1/1984 | Abbott et al. . | |
| 4,425,426 | 1/1984 | Abbott et al. . | |
| 4,803,150 | 2/1989 | Dickerson et al. . | |
| 4,868,399 | 9/1989 | Sephton . | |
| 4,900,652 | 2/1990 | Dickerson et al. . | |
| 5,252,442 | 10/1993 | Dickerson et al. . | |
| 5,260,178 | 11/1993 | Harada et al. . | |
| 5,871,892 | 2/1999 | Dickerson et al. | 430/502 |

*Primary Examiner*—Thorl Chea
*Attorney, Agent, or Firm*—Carl O. Thomas

[57] ABSTRACT

Portal radiographic elements and a process of confirming the targeting of a beam of X-radiation of from 4 to 25 MVp using the portal radiographic elements are disclosed. The X-radiation is directed at a shield containing a port to create a beam. The beam is directed at a selected anatomical feature of a patient over a period of at least 30 seconds. The portion of the beam that passes through the patient impinges on a metal screen, causing it to emit electrons, and the electrons impinge upon a fluorescent screen, causing it to emit light that exposes a portal verification radiographic element to create a latent image in light-sensitized silver halide grains. A processor is employed to convert the latent image to a viewable silver image from which intended targeting of the X-radiation beam can be verified. The processor relies on attenuation of an infrared beam of a wavelength from 850 to 1100 nm by the radiographic element for activation, and at least one of the hydrophilic colloid layers of the radiographic element contains desensitized silver halide grains to increase the specular density of the radiographic element in the wavelength range of infrared sensors that control the processor.

16 Claims, No Drawings

PORTAL VERIFICATION RADIOGRAPHIC ELEMENT AND METHOD OF IMAGING

FIELD OF THE INVENTION

The invention is directed to portal verification radiography with radiation therapy treatment beams and to silver halide radiographic elements and intensifying screens for use in portal verification radiography.

DEFINITION OF TERMS

All references to silver halide grains and emulsions containing two or more halides name the halides in order of ascending concentrations.

The terms "high bromide" and "high chloride" in referring to silver halide grains and emulsions indicate greater than 70 mole percent bromide or chloride, respectively, based on total silver.

The term "equivalent circular diameter" or "ECD" indicates the diameter of a circle having an area equal to the projected area of a grain or particle.

The term "size" in referring to grains and particles, unless otherwise described, indicates ECD.

The term "aspect ratio" indicates the ratio of grain ECD to grain thickness (t).

"Compact particles" are those having an average aspect ratio of less than 2.0.

The "coefficient of variation" (COV) of grain size (ECD) is defined as 100 times the standard deviation of grain size divided by mean grain size.

The term "metal intensifying screen" refers to a metal screen that absorbs MVp level X-radiation to release electrons and absorbs electrons that have been generated by X-radiation prior to reaching the screen.

The term "fluorescent intensifying screen" refers to a screen that absorbs electrons emitted by a metal intensifying screen and emits light.

The term "rare earth" is used to indicate elements having an atomic number of 39 or 57 through 71.

The term "radiographic element" is employed to designate an element capable of producing a viewable silver image upon (a) imagewise direct or indirect (interposed intensifying screen) exposure to X-radiation followed by (b) rapid access processing.

The term "dual-coated" is employed to indicate radiographic elements having image forming layer units coated on opposite sides of a support.

The terms "front" and "back" refer to features or elements nearer to and farther from, respectively, the X-radiation source than the support of the radiographic element.

The term "crossover" as herein employed refers to the percentage of light emitted by a fluorescent intensifying screen that strikes a dual-coated radiographic film and passes through its support to reach the image forming layer unit coated on the opposite side of the support.

The term "RAD" is used to indicate a unit dose of absorbed radiation: an energy absorption of 100 ergs per gram of tissue.

The terms "kVp" and "MVp" stand for peak voltage applied to an X-ray tube X $10^3$ and $10^6$, respectively.

The term "portal" is used to indicate radiographic imaging, films and intensifying screens applied to megavoltage radiotherapy conducted through an opening or port in a radiation shield.

The term "localization" refers to portal imaging that is used to locate the port in relation to the surrounding anatomy of the patient. Typically exposure times range from 1 to 10 seconds.

The term "verification" refers to portal imaging that is used to record patient exposure through the port during radiotherapy. Typically exposure times range from 30 to 300 seconds.

The terms "rapid access processing" and "rapid access processor" are employed to indicate a capability of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "fully forehardened" is employed to indicate the forehardening of hydrophilic colloid layers to limit weight gain during rapid access processing to less than 120 percent of the original dry weight of the hydrophilic colloid.

The term "image tone" refers to appearance of an imaged portal radiographic element on a continuum ranging from cold (i.e., blue-black) to warm (i.e., brown-black) image tones. Image tone is measured in terms of CIE L*a*b* color space using b* values quantify image tone on a blue-yellow color axis. More positive b* values indicate a tendency toward greater yellowness (image warmth). A technique for measurement of b* values is described by Billmeyer and Saltzman, *Principles of Color Technology*, 2nd Ed., Wiley, N.Y., 1981, at Chapter 3.

The term "contrast" as herein employed indicates the average contrast (also referred to as $\gamma$) derived from a characteristic curve of a portal radiographic element using as a first reference point (1) a density ($D_1$) of 0.25 above minimum density and as a second reference point (2) a density ($D_2$) of 2.0 above minimum density, where contrast is $\Delta D$ (i.e. 1.75)$\div\Delta\log_{10}E$ ($\log_{10}E_2-\log_{10}E_1$), $E_1$ and $E_2$ being the exposure levels at the reference points (1) and (2).

The term "covering power" is used to indicate the ratio of maximum density to silver coating coverage and is usually expressed as a percentage.

The term "near infrared" refers to infrared radiation having wavelengths ranging to as long as 1100 nm.

The term "specular density" refers to the density an element presents to a perpendicularly intersecting beam of radiation where penetrating radiation is collected within a collection cone having a half angle of less than 10°, the half angle being the angle that the wall of the cone forms with its axis, which is aligned with the beam. For a background description of density measurement, attention is directed to Thomas, *SPSE Handbook of Photographic Science and Engineering*, John Wiley & Sons, New York, 1973, starting at p. 837.

*Research Disclosure* is published by Kenneth Mason Publications, Ltd., Dudley House, 12 North St., Emsworth, Hampshire P010 7DQ, England.

BACKGROUND

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5 percent or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element. For medical diagnostic imaging, film contrast typically ranges from about 1.8 to 3.2, depending upon the diagnostic application.

Crossover of light from one fluorescent screen to an emulsion layer on the opposite side of the support of the radiographic element results in a significant loss of image sharpness. Crossover is minimized, since this degrades image sharpness and creates the risk of the radiologist failing to observe a significant anatomical feature required for a proper diagnosis. At worst crossover in medical diagnostic elements can range up to about 25 percent, but in the overwhelming majority of medical diagnostic element constructions is less than 20 percent and, in preferred medical diagnostic radiographic elements, crossover is substantially eliminated.

Medical diagnostic X-radiation exposure energies vary from about 25 kVp for mammography to about 140 kVp for chest X-rays.

Examples of radiographic element constructions for medical diagnostic purposes are provided by Abbott et al U.S. Pat. Nos. 4,425,425 and 4,425,426, Dickerson U.S. Pat. No. 4,414,304, Kelly et al U.S. Pat. Nos. 4,803,150 and 4,900,652, Tsaur et al U.S. Pat. No. 5,252,442, and *Research Disclosure*, Vol. 184, August 1979, Item 18431.

Portal radiography is used to provide images to position and confirm radiotherapy in which the patient is given a dose of high energy X-radiation (from 4 to 25 MVp) through a port in a radiation shield. The object is to line up the port with a targeted anatomical feature (typically a tumor) so the feature receives a cell killing dose of X-radiation. In localization imaging the portal radiographic element is briefly exposed to the X-radiation passing through the patient with the shield removed and then with the shield in place. Exposure without the shield provides a faint image of anatomical features that can be used as orientation references near the target (e.g., tumor) area while the exposure with the shield superimposes a second image of the port area. The exposed localization radiographic element is quickly processed to produce a viewable image and to confirm that the port is in fact properly aligned with the intended anatomical target. During the above procedure patient exposure to high energy X-radiation is kept to a minimum. The patient typically receives less than 20 RADs during this procedure and exposure is limited to 10 seconds or less.

Thereafter, before the patient is allowed to move, a cell killing dose of X-radiation is administered through the port. The patient typically receives from 50 to 300 RADs during this step over a period of from 30 to 300 seconds. While the localization imaging procedure is relied upon to direct the high energy X-radiation beam through the port to the portion of the anatomy intended to be killed, there remains a possibility that the patient may have inadvertently shifted position between the localization X-radiation beam targeting and actual radiation therapy. Therefore, it is common practice to conduct radiation therapy with a portal verification radiographic element present. The verification element is exposed only within the area of the port. Within the port area anatomical feature can usually be identified to verify that the radiation therapy has, in fact, been targeted as intended.

A proposed portal radiographic element construction is disclosed by Sephton U.S. Pat. No. 4,868,399.Sephton does not disclose rapid access processing or a film construction capable of undergoing rapid access processing. Sephton further shows dual-coated structures to produce unsatisfactorily low levels of contrast. Sephton discloses portal localization, but not portal verification imaging.

Medical diagnostic imaging has in recent years learned to employ silver halide emulsions at silver coating coverages of less than 30 mg/dm$^2$ by employing tabular grain emulsions. The high ratio of grain projected area to thickness allows high levels of silver image covering power to be realized, as first observed by Dickerson U.S. Pat. No. 4,414,304. The relatively high speeds of tabular grain emulsions render them unsuitable for use in use in portal imaging.

While lower silver coating coverages are in themselves advantageous in saving materials and facilitating rapid access processing, the low silver coverages have presented a problem in using commercially available rapid access processors, since they lack sufficient infrared density to be detected by the sensor beams used to sense the presence of radiographic film in rapid access processors.

Recent attempts to substitute high chloride silver halide emulsions for the high bromide silver halide emulsions most commonly employed in radiographic imaging have compounded the problem. Silver chloride exhibits a significantly lower refractive index than silver bromide and therefore creates lower specular densities when otherwise comparable grains are present at the same coating coverages. When coating coverages are less than 30 mg/dm$^2$, the problem of detecting the presence of radiographic elements is compounded.

Harada et al U.S. Pat. No. 5,260,178 has noted that with low silver coating coverages in radiographic elements, it is impossible for sensors that rely on the scattering of near infrared sensor beams by silver halide grains to sense the presence of the film in the processor. The solution proposed is to incorporate an infrared absorbing dye. Instead of reducing specular density by scattering near infrared radiation, the dye simply absorbs the near infrared radiation of the sensor beam. During processing the dye is deaggregated to shift its absorption peak. In the later stages of processing the density of developed silver is relied upon for interrupting sensor beams, which is the conventional practice.

The difficulty with the Harada et al solution to the problem of insufficient silver halide grain coating coverages to activate infrared sensors is that it relies on the addition of a complex organic material—specifically a tricarbocyanine dye that must have, in addition to the required chromophore for near infrared absorption, a steric structure suitable for aggregation and solubilizing substituents to facilitate deaggregation. The dyes of Harada et al also present the problem of fogging the radiation-sensitive silver halide grains when coated in close proximity, such as in a layer contiguous to a radiation-sensitive emulsion layer. Simply stated, the "cure" that Harada proposes is sufficiently burdensome as to entirely offset the advantage of reduced silver coating coverages, arrived at by years of effort by those responsible for improving films for producing silver images in response to rapid access processing. Thus, Harada's film structure modification is not a problem solution that has practical appeal.

RELATED APPLICATIONS

Dickerson et al U.S. Ser. No. 08/787,035, filed Jan. 28, 1997, titled PORTAL RADIOGRAPHIC IMAGING, discloses processes of portal localization and portal verification imaging. The radiographic elements are capable of rapid access processing.

Hershey et al U.S. Ser. No. 08/840,517, filed Apr. 21, 1997, titled INFRARED SENSOR DETECTABLE IMAGING ELEMENTS, discloses an element capable of forming a silver image containing insufficient radiation-sensitive silver halide grains to render the element detectable by an infrared sensor of a rapid access processor. The element has been modified to increase infrared specular density by the inclusion of, in a hydrophilic colloid dispersing medium, particles (a) removable from the element during a rapid access processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2.

Dickerson et al U.S. Ser. No. 09/069,390, filed concurrently herewith and commonly assigned, titled PORTAL LOCALIZATION RADIOGRAPHIC ELEMENT AND METHOD OF IMAGING, discloses a method of portal localization imaging employing a radiographic element specifically constructed for this use.

SUMMARY OF THE INVENTION

In one aspect, this invention is directed to a process of verifying the targeting of a beam of X-radiation of from 4 to 25 MVp comprised of (a) directing the X-radiation at a shield containing a port to create a beam of the X-radiation passing through the port, (b) over at period of from 30 to 300 seconds directing the beam at a selected anatomical feature of a patient and intercepting that portion of the beam passing through the patient with a radiographic element, thereby creating a latent image in the radiographic element of a portion of the patient's anatomy through which the beam has passed, (c) employing a processor to convert the latent image to a viewable silver image verifying the location of the beam in relation to the selected anatomical feature of the patient, the processor relying on attenuation of an infrared beam of a wavelength from 850 to 1100 nm by the radiographic element for activation, wherein (d) the radiographic element is comprised of a transparent film support having first and second major surfaces and, coated on each of the major surfaces, processing solution permeable hydrophilic colloid layers, at least one of the layers on each major surface including a light-sensitized silver halide grain population capable of providing a contrast in the range of from 4 to 8 and containing greater than 70 mole percent chloride and less than 3 mole percent iodide, based on silver, the total grain population being coated at a silver coverage of less than 30 mg/dm$^2$ and having a mean equivalent circular diameter of less than 0.2 $\mu$m, (e) during step (b), at least one metal screen capable of emitting electrons when exposed to the X-radiation beam is interposed between the X-radiation beam and the radiographic element to receive X-radiation passing through the patient and at least one fluorescent intensifying screen is positioned to receive electrons from the metal screen and emit light to expose the radiographic element, (f) when introduced into the processor in step (c), the radiographic element containing in at least one of the hydrophilic colloid layers desensitized silver halide grains having a mean equivalent circular diameter in the range of from 0.2 to 1.9 $\mu$m to create a specular density capable of attenuating the infrared beam and activating the processor, and (g) during step (c), the light-sensitized silver halide grain population is developed imagewise to produce the viewable silver image and undeveloped silver halide grains are removed from the radiographic element.

In another aspect this invention is directed to a portal verification radiographic element comprised of a transparent film support having first and second major surfaces and, coated on each of the major surfaces, processing solution permeable hydrophilic colloid layers, at least one of said hydrophilic colloid layers on each major surface including a light-sensitized silver halide grain population capable of providing a contrast in the range of from 4 to 8 and containing greater than 70 mole percent chloride and less than 3 mole percent iodide, based on silver, the total grain population being coated at a silver coverage of less than 30 mg/dm$^2$ and having a mean equivalent circular diameter of less than 0.2 $\mu$m, and, in at least one of the hydrophilic colloid layers, desensitized silver halide grains having a mean equivalent circular diameter in the range of from 0.2 to 1.9 $\mu$m to increase the specular density of the radiographic element.

DESCRIPTION OF PREFERRED EMBODIMENTS

A preferred verification portal imaging configuration according to the invention, Localization Assembly A, is schematically shown as follows:

Assembly A

| |
|---|
| Metal Intensifying Screen (front) |

Fluorescent Intensifying Screen (front)

| |
|---|
| Support |
| Fluorescent Layer |

Portal Radiographic Element

| |
|---|
| Imaging Unit (back) |
| Transparent Support |
| Imaging Unit (back) |

Fluorescent Intensifying Screen (back)

| |
|---|
| Fluorescent Layer |
| Support |

| |
|---|
| Metal Intensifying Screen (back) |

A portal verification radiographic element according to the invention is mounted between a pair of fluorescent intensifying screens. This sub-assembly is mounted between front and back metal intensifying screens. The various elements of the assembly are mounted in a cassette to hold the elements of the assembly in the desired relationship during X-radiation exposure and handling. The elements of the assembly are shown spaced apart for each of visualization, but, as mounted in a cassette, adjacent elements are pressed into direct contact.

Only one (front or back) metal intensifying screen and one (front or back) fluorescent screen are required. Specifically preferred alternative screen combinations include (i) the front metal intensifying screen and the front fluorescent screen and (ii) the front and back metal intensifying screens and one (front or back) fluorescent intensifying screen.

The front metal intensifying screen absorbs electrons that are generated by X-radiation absorption within the patient. X-radiation reaching the front and back metal intensifying screens stimulates electron emission. The electron emission from the metal intensifying screens stimulates light emission by the fluorescent intensifying screens that is principally responsible for latent image formation in the portal radiographic element.

During radiation therapy 4 to 25 MVp X-radiation is directed through a port in a shield to create a beam. This beam is directed to a selected anatomical feature of the patient (e.g., a tumor) for purpose of killing cells. Usually a series of X-radiation beam treatments are undertaken over a period of time. To verify that the X-radiation beam has in fact been directed at the intended anatomical feature a portal verification radiographic element is positioned to receive the portion of the X-radiation beam that passes through the patient during radiation therapy. This exposure produces a latent image in the radiographic element. The exposed radiographic element is then passed through a processor to convert the latent image to a viewable silver image. The silver image provides a confirmation of proper X-radiation beam targeting during therapy.

The portal verification radiographic elements of the invention are constructed (a) to employ less than 30 mg/dm$^2$ of silver in the form of silver halide grains, (b) to provide a contrast in the range of from 4 to 8, (c) to be dual-coated to facilitate rapid access processing, (d) to exhibit a crossover in excess of 30 percent, (e) to be detectable in the 850 to 1100 nm range by infrared sensors used to control rapid access processors, and (f) to be transmission readable using a diffuse light source (i.e., a light box), as is standard in medical diagnostic image viewing.

To satisfy requirement (f) the support must be transparent. While the transparent support in its simplest form can consist of any flexible transparent film, it is common practice to modify the surfaces of radiographic film supports by providing subbing layers to promote the adhesion of hydrophilic colloids to the support. Any conventional radiographic film support can be employed. Radiographic film supports usually exhibit these specific features: (1) the film supports are constructed of polyesters to maximize dimensional integrity rather than employing cellulose acetate supports as are most commonly employed in photographic elements and (2) the film supports are blue tinted to contribute the cold (blue-black) image tone sought in the fully processed films. Colorless transparent film supports are also commonly used. Radiographic film supports, including the incorporated blue dyes that contribute to cold image tones, are described in *Research Disclosure*, Vol. 184, August 1979, Item 18431, Section XII. Film Supports. *Research Disclosure*, Vol. 389, September 1994, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthenate) are specifically preferred polyester film supports.

To facilitate rapid access processing, a dual-coated format, requirement (c), which necessarily requires front and back imaging units. It is conceptually possible to construct each of the imaging units of a single hydrophilic colloid layer containing light-sensitized silver halide grains for imaging, with at least one of the hydrophilic colloid layers also containing the desensitized silver halide grains for increasing specular density to satisfy requirement (e).

In practice it is usually preferred to construct the dual-coated portal radiographic element as illustrated by Element I:

| |
|---|
| Surface Overcoat |
| Interlayer |
| Light-Sensitized Emulsion Layer(s) |
| Transparent Film Support |
| Light-Sensitized Emulsion Layer(s) |
| Interlayer |
| Surface Overcoat |

Element I

Each of the surface overcoat, interlayer and light-sensitized emulsion layer or layers forming an imaging unit contain a conventional hydrophilic colloid vehicle. The hydrophilic colloids and commonly associated addenda, such as hardeners, vehicle extenders, and the like, can be selected from among those disclosed by *Research Disclosure*, Item 38957, II. Vehicles, vehicle extenders, vehicle-like addenda and related addenda. Gelatin and gelatin derivatives, such as acetylated or phthalated gelatin, are specifically referred hydrophilic colloic vehicles. To facilitate rapid access processing the hydrophilic colloid is preferably fully forehardened. Useful hardeners are disclosed in Item 38957, Section II, cited above, B. Hardeners.

To facilitate processing in less than 90 seconds the fully forehardened hydrophilic colloid is coated on each side of the transparent support at a coating coverage of less than 65 mg/dm$^2$, as taught by Dickerson et al U.S. Pat. No. 4,900,652, here incorporated by reference. Rapid access processing is less than 60 seconds, less than 45 seconds, and even less than 30 seconds are currently practiced in medical diagnostic imaging. Dickerson U.S. Pat. No. 5,576,156, here incorporated by reference, reports processing in less than 45 seconds by employing hydrophilic colloid coverages of less than 35 mg/dm$^2$ per side in a dual-coated element. While the Dickerson '156 preferred hydrophilic colloid coating coverages of 19 to 33 mg/dm$^2$ are fully applicable to this invention, it is apparent that the higher crossover levels of the portal radiographic elements of this invention allow the particulate crossover control dye of Dickerson '156 to be reduced or eliminated entirely, thereby allowing still lower hydrophilic colloid coating coverages to be employed, as demonstrated in the Examples below. Total hydrophilic colloid coating coverages per side as low as 10 mg/dm$^2$ are contemplated.

In at least one hydrophilic colloid layer on each side of the transparent support are incorporated light-sensitized silver halide grains to form light-sensitized emulsion layers. To facilitate rapid access processing the grains contain less than 3 mole percent iodide, based on silver. The grains contain greater than 70 mole percent chloride, based on silver. Any remaining halide can be bromide. Thus, the light-sensitized silver halide grains can take any of the following compositions: silver chloride, silver iodochloride, silver bromochloride, silver bromoiodochloride or silver iodobromochloride. In an optimum balance of developability, covering power and image tone, the light-sensitized silver halide grains contain from 5 to 20 mole percent bromide, based on silver. Silver bromochloride emulsions are specifically preferred.

The silver halide grains employed for latent image capture are chosen to be high chloride silver halide grains (1) to moderate imaging speeds to offset the extended exposure times encountered in radiotherapy and (2) to facilitate rapid access processing. To make efficient use of silver, total silver coating coverages (i.e., the sum of silver coating coverages on the front and back sides of the support) of the latent image forming grains is limited to less than 30 mg/dm$^2$. Total silver coating coverages of the light-sensitized grains are preferably at least about 10 mg/dm$^2$ and, most preferably, at least 15 mg/dm$^2$.

The high chloride silver halide grains are light-sensitized. That is, they are in all instances chemically sensitized. Conventional chemical sensitization of silver halide grains is disclosed by *Research Disclosure*, Item 38957, IV. Chemical sensitization. Preferably the grains are sulfur and gold sensitized.

These grains must also be capable of responding to light of the wavelengths principally emitted by at least one fluorescent screen. Such emissions can be in the ultraviolet—a spectral region in which high chloride grains possess significant native sensitivity. However, in most instances fluorescent screens emit principally in the visible region of the electromagnetic spectrum, where high chloride grains exhibit little native sensitivity. Therefore, in most instances the light-sensitized silver halide grains additionally include one or more spectral sensitizing dyes adsorbed to the grain surfaces. Spectral sensitizing dyes useful in imparting sensitivity to the silver halide grains within the principal emission wavelength ranges of fluorescent screens are disclosed by *Research Disclosure*, Item 38957, V. Spectral sensitization and desensitization, A. Sensitizing dyes, and *Research Disclosure*, Item 18431, cited above, X. Spectral Sensitization.

Although the high chloride grains must be light-sensitized to be useful for verification imaging, unlike medical diagnostic radiography, grains having the highest attainable levels of light sensitivity are not suitable. The requirement of high chloride grains in itself contributes to controlling their light sensitivity, since silver bromide grains containing low levels of iodide are known to be capable of attaining the highest levels of light sensitivity. The light sensitivity of the grains is also controlled by limiting the mean ECD of the grains to less than 0.2 $\mu$m. An optimum grain size for localization portal imaging is in the range of from about 0.05 to 0.15 $\mu$m.

To achieve high levels of contrast, within the contemplated range of from 4 to 8, it is contemplated to employ a light-sensitized grain population having a grain size coefficient of variation of less than 20 percent, optimally less than 10 percent. The lowest attainable grain size COV's are preferred. Generally regular grains, those lacking internal stacking faults (e.g., twin planes and screw dislocations) are most readily prepared having low levels of grain size dispersity. Cubic and tetradecahedral high chloride grains are specifically preferred.

In addition to controlling grain size dispersity, the contrast of the portal radiographic elements are contemplated to be raised by the incorporation of one or more contrast enhancing dopants in the light-sensitized grains. Rhodium, cadmium, lead and bismuth are all well known to increase contrast by restraining toe development. The toxicity of cadmium has precluded its continued use. Rhodium is most commonly employed to increase contrast and is specifically preferred. Contrast enhancing concentrations are known to range from as low $10^{-9}$ mole/Ag mole. Rhodium concentrations up to $5\times10^{-3}$ mole/Ag mole are specifically contemplated. A specifically preferred rhodium doping level is from $1\times10^{-6}$ to $1\times10^{-4}$ mole/Ag mole.

A variety of other dopants are known, individually and in combination, to improve not only contrast, but other common properties, such as speed and reciprocity characteristics. Iridium dopants are very commonly employed to decrease reciprocity failure. The extended exposure times of the portal radiographic elements of the invention render it highly desirable to include one or more dopants to guard against low intensity reciprocity failure, commonly referred to as LIRF. Kim U.S. Pat. No. 4,997,751, here incorporated by reference, provides a specific illustration of Ir doping to reduce LIRF. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4) and (5).

The low COV emulsions of the invention can be selected from among those prepared by conventional batch double-jet precipitation techniques. The emulsions can be prepared, for example, by incorporating a rhodium dopant during the precipitation of monodispersed emulsions of the type commonly employed in photographic reflection print elements. Specific examples of these emulsions are provided by Hasebe et al U.S. Pat. No. 4,865,962, Suzumoto et al U.S. Pat. No. 5,252,454, and Oshima et al U.S. Pat. No. 5,252,456, the disclosures of which are here incorporated by reference. A general summary of silver halide emulsions and their preparation is provided by *Research Disclosure*, Item 38957, cited above, I. Emulsion grains and their preparation.

The combination of a high chloride silver halide composition and total silver coating coverages of light-sensitized grains of less than 30 mg/dm$^2$ makes it difficult for the infrared sensor beams in rapid access processors to sense the presence of the portal radiographic element. To overcome this difficulty, the specular density of the portal radiographic elements to infrared radiation in the wavelength range of rapid access processor infrared sensor beams (850 to 1100 nm) is increased by the presence of desensitized silver halide grains dispersed in at least one of the hydrophilic colloid layers.

To avoid any unintended interaction of the desensitized silver halide grains with the light-sensitized silver halide grains, the former are preferably located in one or more hydrophilic colloid layers other than those that contain the light-sensitized grains. The desensitized grains are ideally located in a hydrophilic colloid layer that receives light from a fluorescent screen subsequent to the passing through an emulsion layer, since this minimizes light scattering during imagewise exposure of the light-sensitized grains. However, since reductions in image sharpness that would be objectionable to medical diagnostic imaging are tolerable for verification portal imaging, the desensitized grains are not restricted in location to any particular hydrophilic colloid layer or layers.

It is possible simply to desensitize a portion of the same types of grains used for latent image formation. No overall saving in silver coating coverage is provided when this approach is undertaken, but it has the advantage of avoiding an undesirable increase in speed that would result from increasing the coating coverage of light-sensitized grains. Notice that the minimum exposure of 30 seconds required for radiation therapy is much than those employed for solely imaging exposures.

To increase the specular density of the radiographic elements of the invention for detection by processor sensors in the near infrared 850 to 1100 nm range for with lower overall silver coating coverages, it is contemplated to select the desensitized grains based on at least one of composition, grain size and grain shape to increase specular density.

Although the rate of printout of the desensitized grains when retained in a fully processed portal verification radiographic element can be sufficiently restrained to be tolerable, to allow archival keeping it is preferred that the desensitized grains be removed along with the light-sensitized grains during processing. Even if the particles were sufficiently stable to remain permanently unaltered in the processed film, the image bearing element has a hazy appearance, which degrades and may obscure the images obtained. To facilitate desensitized grain removal during processing, it is preferred that the desensitized grains contain less than 3 (most preferably less than 1) mole percent iodide, based on silver.

If very rapid processing is contemplated, high chloride silver halide grains can be employed both as light-sensitized grains and as desensitized grains. To facilitate higher specular densities with lower silver coating coverages it is preferred that the desensitized grains contain greater than 50 mole percent bromide, based on silver. Most preferably the grains are high bromide grains. Any remaining halide is preferably chloride. Iodide is preferably absent. In a specifically preferred form the desensitized high bromide grains are silver bromide grains.

The desensitized grains preferably have a mean size of from 0.2 to 1.9 $\mu$m, most preferably 0.3 to 1.1 $\mu$m. The optimum mean particle size for scattering near infrared radiation in the sensor wavelength range is approximately 0.7 $\mu$m; therefore an optimum size range is from 0.5 to 0.9 $\mu$m. When the particles are compact (i.e., have an average aspect ratio of <2.0), they are more or less randomly oriented in the layer or layers in which they are incorporated and hence scatter infrared radiation more efficiently than highly asymmetric particles, such as tabular grains, that orient themselves with a major crystal face parallel to the film support.

The grains introduced solely for increasing the specular density of the radiographic elements are not chemically or spectrally sensitized. This in itself assures that these grains are require much higher exposures to form a latent image. However, with exposure times exceeding 30 seconds, merely withholding sensitizers is not sufficient in itself to prevent latent image formation.

It is therefore contemplated to desensitize this additional silver halide grain population. Any convenient conventional technique of grain desensitization can be employed. Dopants, such as those set forth above for increasing contrast by restraining toe development, also reduce speed, which is normally measured in the toe portion of a characteristic curve. A grain that is chemically and spectrally sensitized and doped with rhodium, cadmium, lead or bismuth is somewhat slower than it have been otherwise, but it is still highly useful for latent image formation. A grain that is not chemically or spectrally sensitized and is then doped with one of these dopants has its speed further reduced so that it does not participate in latent image formation, even when exposures are extended over the long time periods of radiation therapy.

In addition to or as an alternative to employing toe development restrainers as desensitizers, grains introduced solely to increase spectral density can be desensitized by adsorbing to the surfaces of the grains conventional organic desensitizers. These compounds typically contain at least one nitrogen atom in a five (azole) or six (azine) member ring. The nitrogen atom or atoms promote adsorption. Often a divalent sulfur atom is also present to promote adsorption. The adsorbed heterocyclic ring structures in themselves promote grain desensitization to varying degrees. For example, 5-mercaptotetrazoles are strong desensitizers.

To increase the desensitizing action of azole and azine heterocycles it is common practice to add to the azole or azine ring one or more strongly electron withdrawing substituents, such as nitro, acetyl, benzoyl, sulfonyl, benzosulfonyl and cyano groups. Preferred strongly electron withdrawing substituents include those having Hammett sigma values more positive than 0.5 are preferred.

Examples of adsorbed desensitizers of the types described above include N,N'-diallyl-4,4'-bispyridinium salts, nitron and its salts, tiuram disulfide, piazine, nitro-1,2,3,-benzothiazole, nitroindazole and 5-mercaptotetrazole, as taught by Peterson et al U.S. Pat. No. 2,271,229, Kendall et al U.S. Pat. No. 2,541,472, Abbott et al U.S. Pat. No. 3,295,976, Rees et al U.S. Pat. Nos. 3,184,313 and 3,402,025, Gibbons et al U.S. Pat. No. 4,840,889, and Pietsch et al East German patent publication DD 298 969.

It is apparent that the basic nuclei of polymethine dyes, particularly cyanine and merocyanine dyes, are azole and azine rings that promote adsorption to silver halide grains. It is also well known that spectral sensitizing dyes desensitize silver halide grains to varying degrees within the spectral region to which they possess native sensitivity. For example, a spectral sensitizing dye having an absorption peak in the red region of the spectrum actually desensitizes silver bromide grains in the short blue region of the spectrum. It is therefore apparent that spectral sensitizing dyes that absorb outside the spectral region of fluorescent screen emission can be used as desensitizers. By adding one or more of the highly electron withdrawing substituents noted above to the dyes the desensitizing action of the spectral sensitizing dyes can be greatly increased. Spectral sensitizing dyes that act as desensitizers for negative-working silver halide emulsions (used as sensitizers for fogged direct-positive emulsions) are specifically contemplated. Specific illustrations of desensitizing nuclei used in these types of dyes, optionally augmented with strongly electron withdrawing substituents are disclosed in *Research Disclosure*, Item 38957, V. Spectral sensitization and desensitization, A. Sensitizing dyes, particularly paragraph (8).

Any threshold amount of the desensitized grains that detectably increase specular density to near infrared radiation in the 850 to 1100 nm wavelength range can be employed. The amount required to raise the specular density of the element to the level of detectability by processor sensors will vary, depending on the level of specular density which the light-sensitized grains provide. In all instances the combined total silver coating coverage of the light-sensitized grains and desensitized grains remains less than 30 mg/dm$^2$. Since the desensitized grains can be selected by composition, size and shape to enhance the specular density of the portal verification radiographic element, it is appreciated that portal radiographic elements according to the invention can be constructed with total silver coating coverages well below 30 mg/dm$^2$.

A convenient location for placing the desensitized grains is in the surface overcoat or interlayer overlying the emulsion layer or layers. Placement of the desensitized grains on both sides of the support in layers near the surface of the portal verification radiographic element facilitates removal of the particles during rapid access processing.

The surface overcoat and interlayer contain hydrophilic colloid, described above, as a vehicle. A primary function of the surface overcoat is to provide physical protection for the underlying emulsion layer(s). Other conventional components are disclosed in *Research Disclosure*, Item 18431, cited above, III. Antistatic Agents/Layers and IV. Overcoat Layers and *Research Disclosure*, Item 38957, cited above, IX. Coating physical property and modifying addenda, A. Coating aids, B. Plasticizers and lubricants, C. Antistats, and D. Matting agents. The interlayer can be omitted, but is usually included to provide a thin layer of separation between the addenda of the surface overcoat and the next adjacent emulsion layer. Addenda, that do not interact with emulsion layer components, such as matting agents, are often placed in the interlayer. Thus, placement of specular density increasing desensitized grains in the interlayers is specifically contemplated.

Other conventional addenda can be placed in the portal verification radiographic elements of the invention, if desired. For example, instability that increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II. Emulsion Stabilizers, Antifoggants and Antikinking Agents.

The fluorescent intensifying screens can take any convenient conventional form. High resolution fluorescent intensifying screens, such as, for example, those employed in mammography, are unnecessary, since the object is simply to provide images with identifiable anatomical features, not the fine detail required for diagnostics. The fluorescent layers can take any of the forms of those found in conventional fluorescent intensifying screens. The comparatively long duration exposures of verification imaging provide sufficient energy for stimulating fluorescence that speed increasing constructions are not required to provide sufficient light for radiographic element exposure. For example, although the fluorescent layer support is most commonly reflective, a transparent or even black support is preferred. Examples of conventional, useful fluorescent intensifying screens are provided by *Research Disclosure*, Item 18431, cited above, Section IX. X-Ray Screens/Phosphors, and Bunch et al U.S. Pat. No. 5,021,327 and Dickerson et al U.S. Pat. Nos. 4,994,355, 4,997,750, and 5,108,881, the disclosures of which are here incorporated by reference. The fluorescent layer contains phosphor particles and a binder. It is a common practice to place a small amount of carbon in the binder of the fluorescent layer to increase image resolution. In this application the principal advantage is in moderating light emission by the fluorescent layer. Higher emission efficiencies are realized with phosphors such as calcium tungstate ($CaWO_4$) niobium and/or rare earth activated yttrium, lutetium or gadolinium tantalates, and rare earth activated rare earth oxychalcogenides and halides.

The rare earth oxychalcogenide and halide phosphors are preferably chosen from among those of the following formula:

$$M_{(w-n)}M'_nO_wX \quad \text{(I)}$$

wherein

M is at least one of the metals yttrium, lanthanum, gadolinium or lutetium,

M' is at least of the rare earth metals, preferably dysprosium, erbium, europium, holmium, neodymium, praseodymium, samarium, terbium, thulium, or ytterbium, X is a middle chalcogen (S, Se or Te) or halogen, n is 0.002 to 0.2, and w is 1 when X is halogen or 2 when X is chalcogen.

The metal intensifying screens can take any convenient conventional form. While the metal intensifying screens can be formed of many different types of materials, the use of metals is most common, since metals are most easily fabricated as thin foils, often mounted on radiation transparent backings to facilitate handling. Convenient metals for screen fabrication are in the atomic number range of from 22 (titanium) to 82 (lead). Metals such as copper, lead, tungsten, iron and tantalum have been most commonly used for screen fabrication with lead and copper in that order being the most commonly employed metals.

The metal foils typically range from 0.1 to 2 mm in thickness when employed as a front screen. A preferred front screen thickness range for lead is from about 0.1 to 1 mm and for copper from 0.25 to 2 mm. Generally the higher the atomic number, the higher the density of the metal and the greater its ability to absorb MVp X-radiation.

The back metal intensifying screens can be constructed of the same materials as the front intensifying screens. In the case of the back metal intensifying screen, the only advantage to be gained by limiting their thickness is reduction in overall cassette weight. Since a back metal intensifying screen is not essential, there obviously is no minimum essential thickness, but typically the back metal intensifying screen is at least as thick as the front metal intensifying screen with which it is used when both are of the same composition. Generally the thickness of the back metal intensifying screen is determined on the basis of convenience of fabrication and handling and the weight it adds to the cassette assembly.

Instead of employing separate metal and fluorescent intensifying screens, it is possible to integrate both functions into a single element by coating a fluorescent layer onto one or both of the metal intensifying screens.

Rapid access processing can be illustrated by reference to the Kodak X-OMAT M6A-N™ rapid access processor, which employs the following processing cycle (hereinafter referred to as Reference 1):

| | |
|---|---|
| development | 24 seconds at 35° C. |
| fixing | 20 seconds at 35° C. |
| washing | 20 seconds at 35° C. |
| drying | 20 seconds at 65° C. |

with less than 6 seconds being taken up in film transport between processing steps.

A typical developer employed in this processor exhibits the following composition:

| | |
|---|---|
| hydroquinone | 30 g |
| 1-phenyl-3-pyrazolidone | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-methylbenzotriazole | 0.06 g |
| glutaraldehyde | 4.9 g |
| water to 1 liter at a pH 10.0. | |

A typical fixer employed in this processor exhibits the following composition:

| | |
|---|---|
| $Na_2S_2O_3$ in water at 60% of total weight in water | 260.0 g |
| $NaHSO_3$ | 180.0 g |
| boric acid | 25.0 g |
| acetic acid | 10.0 g |
| water to 1 liter at a pH of 3.9–4.5. | |

Numerous variations of the reference processing cycle (including, shorter processing times and varied developer and fixer compositions) are known. For example, Dickerson U.S. Pat. No. 5,576,156 discloses a Kodak X-Omat RA 480 rapid access processor set for the following process cycle:

| | |
|---|---|
| development | 11.1 seconds at 40° C. |
| fixing | 9.4 seconds at 30° C. |
| washing | 7.6 seconds at room temperature |
| drying | 12.2 seconds at 67.5° C. |

employing the following developer:

| | |
|---|---|
| hydroquinone | 32 g |
| 4-hydroxymethyl-4-methyl-1-phenyl-3-pyrazolidone | 6 g |
| KBr | 2.25 g |
| $Na_2S_2O_3$ | 160 g |
| 5-methylbenzotriazole | 0.125 g |
| water to 1 liter at a pH 10.0. | |

Rapid access processors are typically activated when an imagewise exposed element is introduced for processing. Silver halide grains in the element interrupt an infrared sensor beam in the wavelength range of from 850 to 1100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. A further description of sensor control of a rapid access processor is provided by Harada et al U.S. Pat. No. 5,260,178, cited above and here incorporated by reference.

EXAMPLES

The invention can be better appreciated by reference to the following specific embodiments. In the examples all coating coverages are in units of mg/dm$^2$, except as otherwise indicated.

PVRE-1

A portal verification radiographic element exhibiting a crossover of 40% and an average contrast of >4.0 satisfying the requirements of the invention was constructed to have the following structure:

| |
|---|
| SURFACE OVERCOAT |
| INTERLAYER |
| EMULSION LAYER |
| SUPPORT |
| EMULSION LAYER |
| INTERLAYER |
| SURFACE OVERCOAT |

(PVRE-1)

| | Coverage |
|---|---|
| Surface Overcoat | |
| Gelatin | 3.4 |
| Methyl methacrylate (matte beads) | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

-continued

| |
|---|
| SURFACE OVERCOAT |
| INTERLAYER |
| EMULSION LAYER |
| SUPPORT |
| EMULSION LAYER |
| INTERLAYER |
| SURFACE OVERCOAT |

(PVRE-1)

| | Coverage |
|---|---|
| Interlayer | |
| Gelatin | 3.4 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Emulsion Layer | |
| $AgI_1Br_9Cl_{90}$ (ECD 0.1 $\mu$m) ($6.9 \times 10^{-5}$ gram atoms Rh per Ag mole) (sulfur and gold sensitized) | 8.8 |
| Gelatin | 24.2 |
| 5-Bromo-4-hydroxy-6-methyl-1,3,3A,7-tetraazaindene | 200 mg/Ag mole |
| 5-Carboxy-4-hydroxy-6-methyl-2-methyl-mercapto-1,3,3A,7-tetraazaindene | 0.043 |
| Sensitizing Dye-1 3-Carboxymethyl-5-[(3-methyl-2(3H)-thiazolin ylidene)isopropylidene]rhodanine | 0.15 |
| Sensitizing Dye-2 3-Ethyl-5-[1-(4-sulfobutyl)-4(1H)-pyridyliene) rhodanine | 0.69 |
| Bis(vinylsulfonylmethyl)ether based on weight of gelatin | 2.4%, by wt, |

PVRE-2

This portal verification radiographic element was constructed identically to PVRE-1, except that 3.2 mg/dm$^2$ of 0.8 $\mu$m AgBr cubic grains that were neither chemically nor spectrally sensitized were added to each of the interlayers. In other words, the grains were not light-sensitized, nor were they light-desensitized.

PVRE-3

This portal verification radiographic element was constructed identically to PVRE-2, except that the AgBr grains were desensitized by the addition of 2.4×10−8 gram atoms of rhodium per silver mole.

PVRE-4

This portal verification radiographic element was constructed identically to PVRE-2, except that the AgBr grains were desensitized by adsorbing to the surface of the grains prior to interlayer addition 10 mg/Ag mole of the desensitizing spectral sensitizing dye 3'-ethyl-3-methyl-6-nitro-thiathiazolinocyanine iodide.

PVRE-5

This portal verification radiographic element was constructed identically to PVRE-3, except that the AgBr grains were desensitized by adsorbing to the surface of the grains prior to interlayer addition 10 mg/Ag mole of the desensitizer 6-chloro-4-nitro-1,2,3-benzotriazole.

Exposure

Each portal verification film was mounted in a cassette between a pair of fluorescent intensifying screens. Each fluorescent intensifying screen consisted of a terbium activated gadolinium oxysulfide phosphor having a median particle size of 7 μm coated on a white pigmented poly (ethylene terephalate) film support in a Permuthane™ polyurethane binder at a total phosphor coverage of 13.3 g/dm$^2$ at a phosphor to binder ratio of 19:1.

The screen-film assemblies were exposed to 70 KVp X-radiation, varying either current (milliamperes) or time, using a 3-phase Picker Medical (Modeal VTX-650)™ X-ray unit containing filtration up to 3 mm of aluminum. Sensitometric gradations in exposure were achieved using a 21 increment (0.1 log E) aluminum step wedge of varying thickness. Although lower energy X-radiation was used to stimulate the fluorescent screens, X-radiation exposures were chosen to create light emissions from the fluorescent screens comparable to those obtainable using higher energy X-radiation to expose intermediate metal intensifying screens to stimulate the fluorescent screens. An exposure time of 60 seconds was undertaken.

Rapid Access Processing

Rapid access processing of film samples was accomplished using a Kodak 480 RA X-Omat™ processor adjusted for the following processing cycle:

| | |
|---|---|
| Development | 11.1 sec., 37° C. |
| Fixing | 9.4 sec., 35° C. |
| Wash | 7.6 sec., 35° C. |
| Drying | 12.2 sec., 60° C. |
| Total time | 40.3 sec. |

The developer composition was as follows:

| Component | g/L |
|---|---|
| Hydroquinone | 32.0 |
| 4-Hydroxymethyl-4-methyl-1-phenyl-pyrazolidone | 6.0 |
| Potassium bromide | 2.25 |
| 5-Methylbenzotriazole | 0.125 |
| Sodium sulfite | 160.0 |
| pH 10.35 | |
| Water to 1 L | |
| The fixer composition as follows: | |
| Ammonium thiosulfate | 131.0 |
| Sodium thiosulfate | 15.0 |
| Sodium bisulfate | 180.0 |
| Boric acid | 25.0 |
| Acetic acid | 10.0 |
| pH 4.9 | |
| Water to 1 L | |

Performance Evaluation

The performance results are summarized below in Table I:

TABLE I

| Element | Toe Speed | Mid-Scale Speed | γ | Density @ 940 nm |
|---|---|---|---|---|
| PVRE-1 | 100 | 100 | 5.1 | 0.18 |
| PVRE-2 | 246 | 105 | 1.1 | 1.09 |
| PVRE-3 | 100 | 100 | 4.7 | 1.62 |
| PVRE-4 | 100 | 101 | 4.8 | 1.14 |
| PVRE-5 | 100 | 103 | 4.8 | 1.11 |

Toe speed was measured at a density of 0.25 above minimum density. Mid-scale density was measured a density of 1.00 above minimum density. The speeds are reported as relative speeds where each unit of relative speed difference amounts to an difference of 0.01 log E, where E is exposure in luxseconds received from the fluorescent screens.

The choice of the light-sensitized grains for PVRE-1 was judged near optimum for portal verification imaging. Unfortunately this element exhibited a specular density at 940 nm of only 0.18, well below the 0.8 density in the 850 to 1100 nm region considered necessary for reliable rapid accessor processor near infrared film sensors.

PVRE-2, which differed from PVRE-1 by the addition of unsensitized AgBr grains, increased the specular density of the element at 940 nm to 1.09, well above the preferred optimum density of at least 0.90 sought for reliable detection of the film by infrared film sensors in the processor. Unfortunately, the addition of even unsensitized AgBr grains increased toe speed by 1.46 log E (each increase of 0.3 log E amounting to a doubling of speed). Thus, the film PVRE-2 was almost 32 times faster than PVRE-1. Thus, PVRE-2 was judged too fast for the extended exposure times of radiotherapy. In addition, the increase in toe speed lowered contrast below the minimum value of 4 needed to facilitate anatomical feature identification.

PVRE-3, which differed by PVRE-2 by the addition of rhodium dopant to the AgBr grains, satisfied the speed, contrast and 940 nm specular density characteristics sought in a portal verification radiographic element. PVRE-3 satisfied the requirements of the invention.

Similarly, PVRE-4 and PVRE-5 demonstrated that, instead of relying on a rhodium dopant to desensitize the AgBr grains, the same desensitization can be imparted by adsorbing either a desensitizing dye or a known non-dye desensitizer.

The invention has been described in detail with particular reference to preferred embodiments thereof, but it will be understood that variations and modifications can be effected within the spirit and scope of the invention.

What is claimed is:

1. A process of verifying the targeting of a beam of X-radiation of from 4 to 25 MVp comprised of (a) directing the X-radiation at a shield containing a port to create a beam of the X-radiation passing through the port, (b) over at period of from 30 to 300 seconds directing the beam at a selected anatomical feature of a patient and intercepting that portion of the beam passing through the patient with a radiographic element, thereby creating a latent image in the radiographic element of a portion of the patient's anatomy through which the beam has passed, (c) employing a processor to convert the latent image to a viewable silver image verifying the location of the beam in relation to the selected anatomical feature of the patient, the processor relying on attenuation of an infrared beam of a wavelength from 850 to 1100 nm by the radiographic element for activation,

WHEREIN (d) the radiographic element is comprised of a transparent film support having first and second major surfaces and, coated on each of the major surfaces, processing solution permeable hydrophilic colloid layers, at least one of said layers on each major surface including a light-sensitized silver halide grain population capable of providing a contrast in the range of from 4 to 8 and containing greater than 70 mole percent chloride and less than 3 mole percent iodide, based on silver, the total grain population being coated at a silver coverage of less than 30 mg/dm$^2$ and having a mean equivalent circular diameter of less than 0.2 $\mu$m, (e) during step (b), at least one metal screen capable of emitting electrons when exposed to the X-radiation beam is interposed between the X-radiation beam and the radiographic element to receive X-radiation passing through the patient and at least one fluorescent intensifying screen is positioned to receive electrons from the metal screen and emit light to expose the radiographic element, (f) when introduced into the processor in step (c), the radiographic element of (d) which further contains in at least one of the hydrophilic colloid layers, desensitized silver halide grains having a mean equivalent circular diameter in the range of from 0.2 to 1.9 $\mu$m to create a specular density capable of attenuating the infrared beam and activating the processor, and (g) during step (c), the light-sensitized silver halide grain population is developed imagewise to produce the viewable silver image and undeveloped silver halide grains are removed from the radiographic element.

2. A process according to claim 1 wherein the radiographic element contains less than 65 mg/dm$^2$ of hydrophilic colloid on each side of the support and is processed in less than 90 seconds.

3. A process according to claim 2 wherein the radiographic element contains 35 mg/dm$^2$ of hydrophilic colloid on each side of the support and is processed in less than 45 seconds.

4. A portal verification radiographic element comprised of a transparent film support having first and second major surfaces and, coated on each of the major surfaces, processing solution permeable hydrophilic colloid layers, at least one of said hydrophilic colloid layers on each major surface including a light-sensitized silver halide grain population capable of providing a contrast in the range of from 4 to 8 and containing greater than 70 mole percent chloride and less than 3 mole percent iodide, based on silver, the total grain population being coated at a silver coverage of less than 30 mg/dm$^2$ and having a mean equivalent circular diameter of less than 0.2 $\mu$m, and, in at least one of the hydrophilic colloid layers, desensitized silver halide grains having a mean equivalent circular diameter in the range of from 0.2 to 1.9 $\mu$m to increase the specular density of the radiographic element.

5. A portal verification radiographic element according to claim 4 wherein the hydrophilic colloid layers are fully forehardened.

6. A portal verification radiographic element according to claim 4 wherein the light-sensitized silver halide grains have a coefficient of variation of grain size of less than 20 percent.

7. A portal radiographic element according to claim 4 wherein the light-sensitized silver halide grains have a mean equivalent circular diameter in the range of from 0.05 to 0.15 $\mu$m.

8. A portal verification radiographic element according to claim 4 wherein the desensitized silver halide grains have a mean equivalent circular diameter in the range of from 0.3 to 1.1 $\mu$m.

9. A portal verification radiographic element according to claim 8 wherein the desensitized silver halide grains have a mean equivalent circular diameter in the range of from 0.5 to 0.9 $\mu$m.

10. A portal verification radiographic element according to claim 4 wherein the desensitized grains include an adsorbed organic desensitizer.

11. A portal verification radiographic element according to claim 4 wherein the desensitized grains include a dopant capable of trapping electrons.

12. A portal verification radiographic element according to claim 11 wherein the desensitized grains contain rhodium as a dopant.

13. A portal verification radiographic element according to claim 4 wherein the desensitized grains contain less than 3 mole percent iodide, based on silver.

14. A portal verification radiographic element according to claim 13 wherein the desensitized grains contain greater than 70 mole percent bromide, based on silver.

15. An assembly comprised of a portal verification radiographic element according to claim 4, a metal intensifying screen positioned to receive X-radiation prior to the portal radiographic element, and a fluorescent intensifying positioned to receive electrons from the metal intensifying screen.

16. An assembly comprised of a portal verification radiographic element according to claim 4, a pair of metal intensifying screens on opposite sides of the portal localization radiographic element, and a pair of fluorescent screens, each positioned between a metal intensifying screen and the portal localization radiographic element.

* * * * *